US006126504A

United States Patent [19]

Day

[11] Patent Number: 6,126,504

[45] Date of Patent: Oct. 3, 2000

[54] INFANT FLOTATION DEVICE

[76] Inventor: Lisa L. Day, 1802 E. Legrande Ave., Indianapolis, Ind. 46203

[21] Appl. No.: 09/365,040

[22] Filed: Jul. 30, 1999

[51] Int. Cl.[7] ..... B63C 9/08

[52] U.S. Cl. ..... 441/131; 441/129

[58] Field of Search ..... 441/80, 130, 131, 441/129; 114/351

[56] References Cited

U.S. PATENT DOCUMENTS

| | | | |
|---|---|---|---|
| 2,075,374 | 3/1937 | Tucker | 441/131 |
| 2,562,080 | 7/1951 | Barnes | 441/131 |
| 2,724,843 | 11/1955 | Kimball | 441/131 |
| 4,799,910 | 1/1989 | Kellough | 441/131 |
| 5,046,978 | 9/1991 | Howerton | 441/131 |

*Primary Examiner*—Stephen Avila

[57] ABSTRACT

A infant floatation device for floating an infant user in a body of water. The infant floatation device includes a floatation ring with a center opening therethrough. A cover sheet is wrapped around the floatation ring to substantially cover the floatation ring with a center region of the cover sheet extending through the center hole of the floatation ring such that a lower portion of the center region of the cover sheet downwardly depends from the center hole to form a seat region. The cover sheet has a pair of leg holes therethrough in the lower portion of center region of the cover sheet.

7 Claims, 2 Drawing Sheets

INFANT FLOTATION DEVICE

BACKGROUND OF THE INVENTION

1. Field of the Invention

The present invention relates to floatation devices and more particularly pertains to a new infant floatation device for floating an infant user in a body of water.

2. Description of the Prior Art

The use of floatation devices is known in the prior art. More specifically, floatation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,799,910 by Kellough; U.S. Pat. No. 3,074,084 by Bisch; U.S. Pat. No. 4,601,667 by Hull; U.S. Pat. No. 5,046,998 by Howerton; EPO Patent No. EP 0 284 294 A1 by Smith; U.S. Pat. No. 2,075,374 by Tucker; and EPO Patent No. EP 0 190 848 A2 by Wood.

While these devices fulfill their respective, particular objectives and requirements, the aforementioned patents do not disclose a new infant floatation device. The inventive device includes a floatation ring with a center opening therethrough. A cover sheet is wrapped around the floatation ring to substantially cover the floatation ring with a center region of the cover sheet extending through the center hole of the floatation ring such that a lower portion of the center region of the cover sheet downwardly depends from the center hole to form a seat region. The cover sheet has a pair of leg holes therethrough in the lower portion of center region of the cover sheet.

In these respects, the infant floatation device according to the present invention substantially departs from the conventional concepts and designs of the prior art, and in so doing provides an apparatus primarily developed for the purpose of floating an infant user in a body of water.

SUMMARY OF THE INVENTION

In view of the foregoing disadvantages inherent in the known types of floatation devices now present in the prior art, the present invention provides a new infant floatation device construction wherein the same can be utilized for floating an infant user in a body of water.

The general purpose of the present invention, which will be described subsequently in greater detail, is to provide a new infant floatation device apparatus and method which has many of the advantages of the floatation devices mentioned heretofore and many novel features that result in a new infant floatation device which is not anticipated, rendered obvious, suggested, or even implied by any of the prior art floatation devices, either alone or in any combination thereof.

To attain this, the present invention generally comprises a floatation ring with a center opening therethrough. A cover sheet is wrapped around the floatation ring to substantially cover the floatation ring with a center region of the cover sheet extending through the center hole of the floatation ring such that a lower portion of the center region of the cover sheet downwardly depends from the center hole to form a seat region. The cover sheet has a pair of leg holes therethrough in the lower portion of center region of the cover sheet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant floatation device apparatus and method which has many of the advantages of the floatation devices mentioned heretofore and many novel features that result in a new infant floatation device which is not anticipated, rendered obvious, suggested, or even implied by any of the prior art floatation devices, either alone or in any combination thereof.

It is another object of the present invention to provide a new infant floatation device which may be easily and efficiently manufactured and marketed.

It is a further object of the present invention to provide a new infant floatation device which is of a durable and reliable construction.

An even further object of the present invention is to provide a new infant floatation device which is susceptible of a low cost of manufacture with regard to both materials and labor, and which accordingly is then susceptible of low prices of sale to the consuming public, thereby making such infant floatation device economically available to the buying public.

Still yet another object of the present invention is to provide a new infant floatation device which provides in the apparatuses and methods of the prior art some of the advantages thereof, while simultaneously overcoming some of the disadvantages normally associated therewith.

Still another object of the present invention is to provide a new infant floatation device for floating an infant user in a body of water.

Yet another object of the present invention is to provide a new infant floatation device which includes a floatation ring with a center opening therethrough. A cover sheet is wrapped around the floatation ring to substantially cover the floatation ring with a center region of the cover sheet extending through the center hole of the floatation ring such that a lower portion of the center region of the cover sheet downwardly depends from the center hole to form a seat region. The cover sheet has a pair of leg holes therethrough in the lower portion of center region of the cover sheet.

Still yet another object of the present invention is to provide a new infant floatation device that is designed to be quickly and easily manufactured and also permit quick and easy replacement of damaged elements.

Even still another object of the present invention is to provide a new infant floatation device that helps maintain keeps an infant user in an upright sitting position when in a body of water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
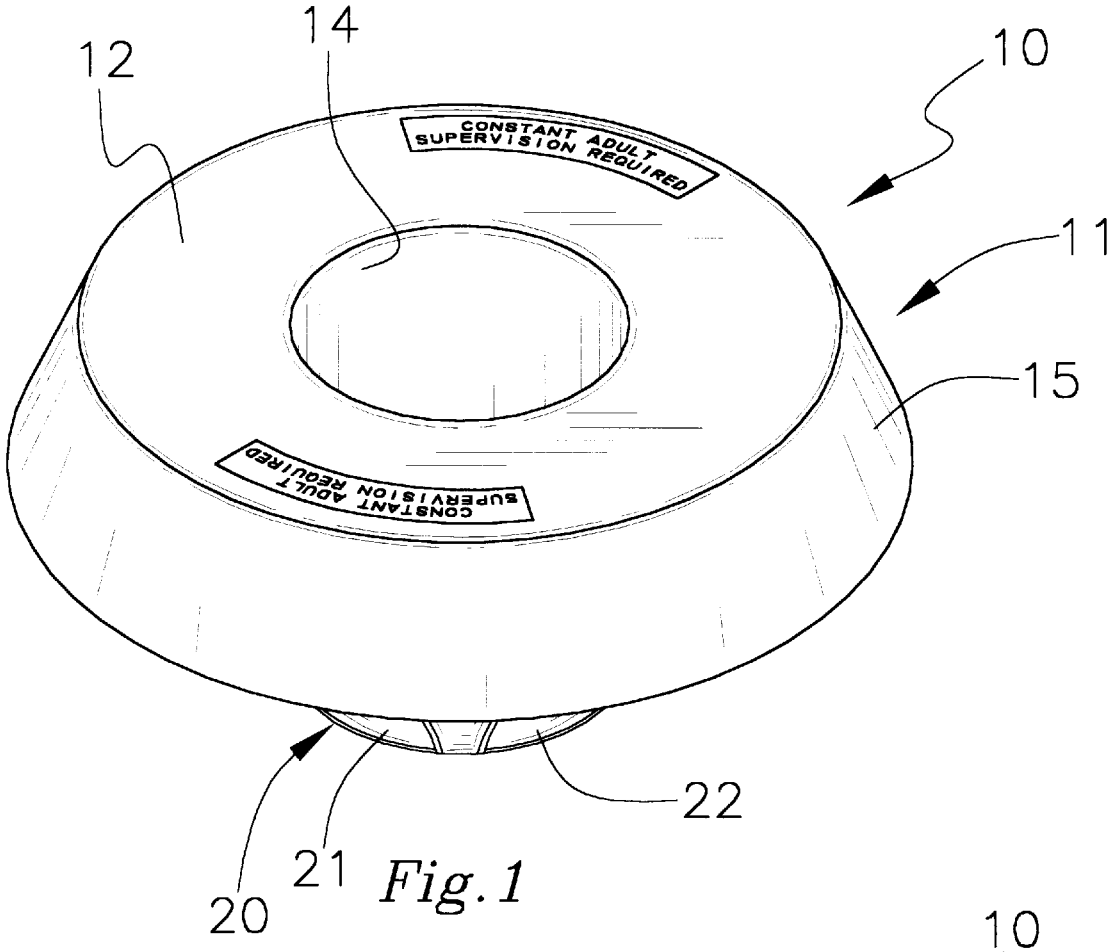
FIG. 1 is a schematic perspective view of a new infant floatation device according to the present invention.
Figure 2:
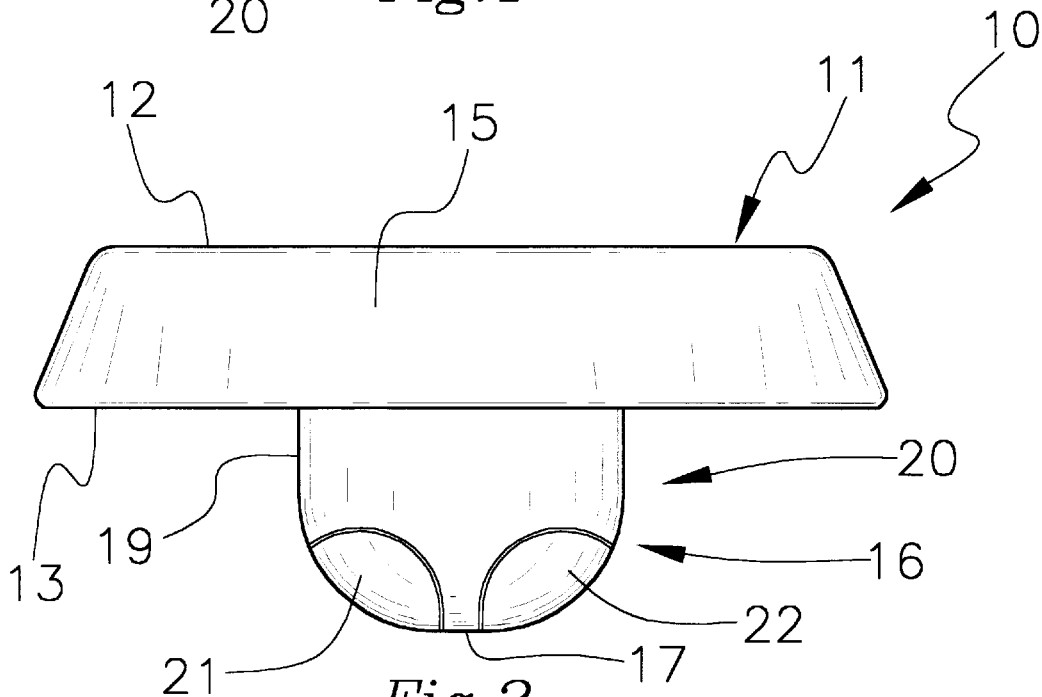
FIG. 2 is a schematic side view of the present invention.
Figure 3:
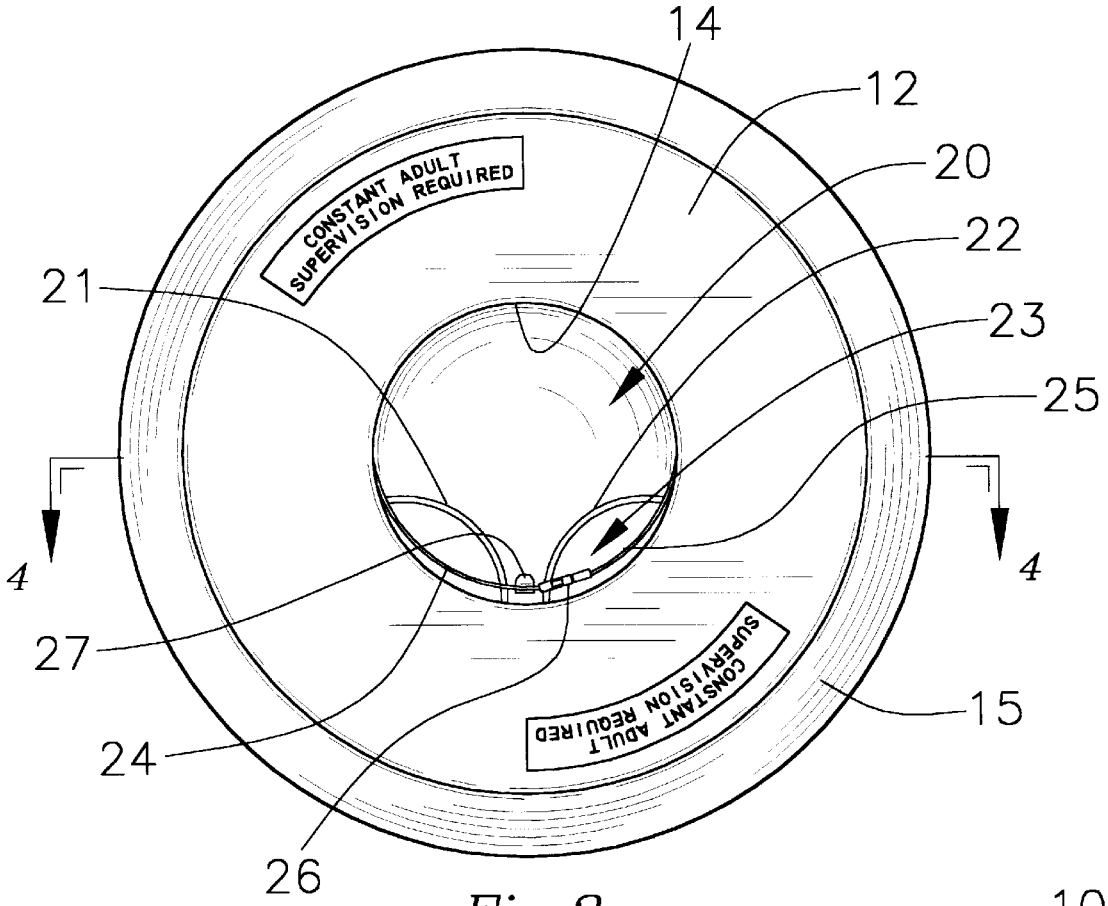
FIG. 3 is a schematic top view of the present invention.

With reference now to the drawings, and in particular to FIGS. 1 through 4 thereof, a new infant floatation device embodying the principles and concepts of the present invention and generally designated by the reference numeral 10 will be described.

As best illustrated in FIGS. 1 through 4, the infant floatation device 10 generally comprises a floatation ring with a center opening therethrough. A cover sheet is wrapped around the floatation ring to substantially cover the floatation ring with a center region of the cover sheet extending through the center hole of the floatation ring such that a lower portion of the center region of the cover sheet downwardly depends from the center hole to form a seat region. The cover sheet has a pair of leg holes therethrough in the lower portion of center region of the cover sheet.

In use, the floatation device 10 is designed for floating an infant user in a body of water in a generally upright position and more specifically comprises a floatation ring 11 with substantially planar upper and lower faces 12,13, and inner and outer sides 14,15. The inner side 14 of the floatation ring defines a generally cylindrical center opening through the ring extending between the upper and lower faces of the floatation ring. The floatation ring preferably comprises a water buoyant rigid foamed material such as foamed polystyrene.

Preferably, the upper and lower faces lie in substantially parallel with one another. In this preferred embodiment, the upper and lower faces of the flotation ring each have a generally circular outer perimeter with substantially coaxial centers.

Preferably, the inner and outer sides of the floatation ring are also coaxial with the centers of the upper and lower faces of the floatation ring. In the preferred embodiment, the inner side of the floatation ring is extended substantially perpendicular to the upper and lower faces of the floatation ring such that the inner side has a generally cylindrical shape.

The upper face of the floatation ring has an outer diameter defined across the outer perimeter of the upper face less than an outer diameter of the lower face of the floatation ring defined across the outer perimeter of the lower face of the floatation ring. This configuration shapes the outer side of the floatation ring to extend at an acute angle to the lower face of the floatation ring and at an obtuse angle to the upper face of the floatation ring. This way, the outer side has a generally frusta-conical shape tapering in a direction from the lower face to the upper face of the floatation ring to provide enhanced stability to the to the floatation ring when floating in a body of water.

In an ideal illustrative embodiment, the floatation ring has a thickness defined between the upper and lower faces of the floatation ring of about 6 inches, the outer diameter of the upper face of the floatation ring is about 32 inches and the outer diameter of the lower face of the floatation ring is about 38 inches. Also in the ideal illustrative embodiment, the center hole of the floatation ring preferably has an outer diameter of about 12 inches.

Figure 4:
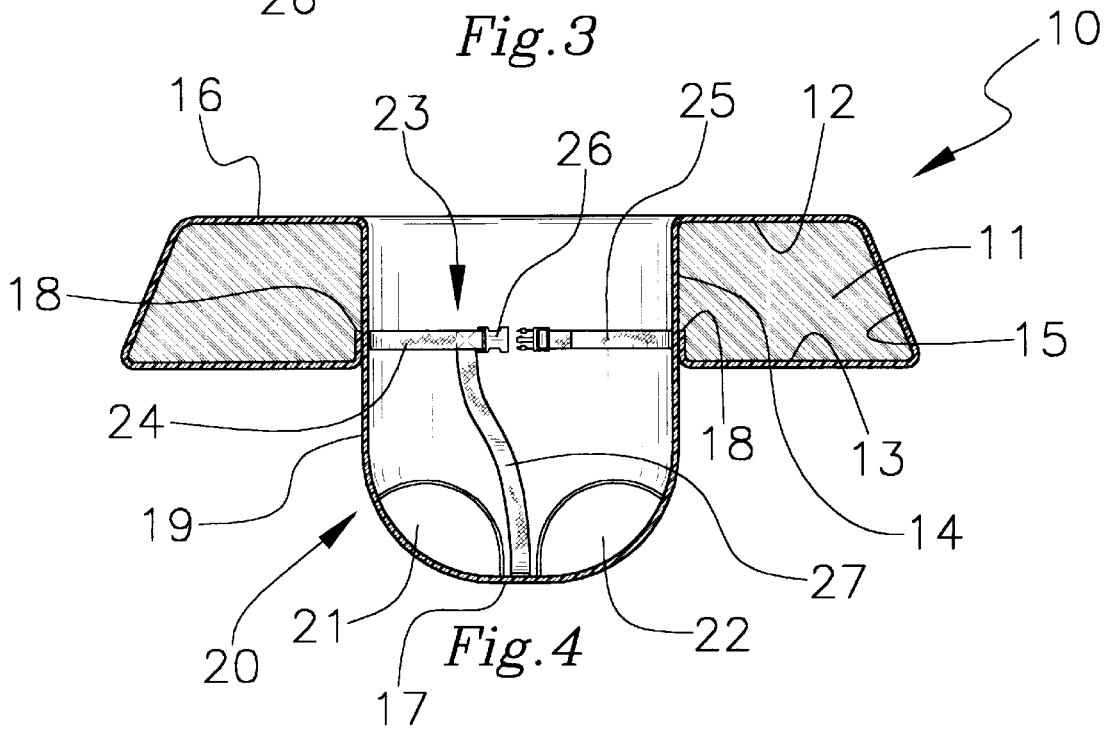
FIG. 4 is a schematic cross sectional view of the present invention taken from line 4—4 of FIG. 3.

The device also has a flexible cover sheet 16 with a center region 17 and a preferably generally circular outer perimeter 18. As best illustrated in FIG. 4, the outer perimeter of the cover sheet is coupled to the floatation ring along the inner side of the floatation ring adjacent the lower face of the floatation ring. The cover sheet is wrapped around the floatation ring to substantially cover the lower face, the outer side, the upper face, and the inner side of the floatation ring such that the outer perimeter of the cover sheet is positioned about the inner side of the floatation ring adjacent the lower face of the floatation ring and the center region of the cover sheet is extended from the upper face of the floatation ring through the center hole of the floatation ring such that a lower portion 19 of the center region of the cover sheet downwardly depends from the lower face side of the center hole. In other words the cover sheet is extended about the lower face, the outer side, and upper face of the floatation ring to cover the lower face, outer side and upper face of the floatation ring and so that the center region of the cover sheet is extended through the center hole of the floatation ring in direction extending from the upper face to the lower face of the floatation ring such that the center region of the cover sheet covers the inner side of the floatation ring with a portion of the center region of the cover sheet downwardly depending from the lower face side of the center hole of the floatation ring.

Preferably, an adhesive is provided between the floatation ring and the cover sheet couples the cover sheet to the floatation ring. Ideally, the adhesive substantially coats the exterior surface of the floatation ring. This method of coupling permits relatively easy removal of the cover sheet from the floatation device so that the cover sheet and floatation ring may be separated for repair and replacement. Ideally, the cover sheet comprises a flexible vinyl material that is resistant to the passage of water therethrough to provide a waterproof cover to the floatation ring.

The lower portion of the cover sheet forms a scat region 20 designed for receiving a lower torso region of an infant user therein such that the upper torso and head of the user upwardly extend above the upper face of the floatation ring from the center hole. The cover sheet has a pair of leg holes 21,22 therethrough in the lower portion of center region of the cover sheet. The leg holes are designed for extending the legs of a user in the seat region. In the ideal illustrative embodiment, the seat region has an depth defined from the upper face of the floatation ring of about 10 inches so that about 4 inches of the seat region downwardly depends from the lower face side of the center hole. In this ideal embodiment, each of the leg openings preferably has an outer diameter of about 4 inches.

A safety harness 23 is provided in the seat region to secure a user in the seat region. The safety harness preferably comprises a pair of waist straps 24,25 detachably attached together by a quick release buckle 26 and a leg strap 27 coupled to one of the waist straps. The waist straps are also coupled to the cover sheet adjacent the inner side of the floatation ring as illustrated in FIG. 4, and the leg strap is coupled to the lower portion of the center region of the cover sheet between the leg holes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floatation device, comprising:

a floatation ring having upper and lower faces, and inner and outer sides, said inner side of said floatation ring, defining a center opening through said ring extending between said upper and lower faces of said floatation ring;

a flexible cover sheet having a center region and an outer perimeter;

said outer perimeter of said cover sheet being coupled to said floatation ring along said inner side of said floatation ring;

said cover sheet being wrapped around said floatation ring to substantially cover said lower face, said outer side, said upper face, and said inner side of said floatation ring such that said outer perimeter of said cover sheet is positioned about said inner side of said floatation ring adjacent said lower face of said floatation ring and said center region of said cover sheet is extended from said upper face of said floatation ring through said center hole of said floatation ring such that a lower portion of said center region of said cover sheet downwardly depends from the lower face side of said center hole;

said lower portion of said cover sheet forming a seat region adapted for receiving a user therein, said cover sheet having a pair of leg holes therethrough in said lower portion of center region of said cover sheets;

wherein said upper and lower faces lie in substantially parallel planes with one another, wherein said upper and lower faces of said flotation ring each have a generally circular outer perimeter, and wherein said upper and lower faces of said floatation ring have substantially coaxial centers; and wherein said upper face of said floatation ring has an outer diameter defined across said outer perimeter of said upper face less than an outer diameter of said lower face of said floatation ring defined across said outer perimeter of said lower face of said floatation ring, wherein said outer side of said floatation ring extends at an acute angle to said lower face of said floatation ring and at an obtuse angle to said upper face of said floatation ring such that said outer side has a generally frusta-conical shape tapering in a direction from said lower face to said upper face of said floatation ring to provide enhanced stability to said to said floatation ring when floating in a body of water.

2. The floatation device of claim 1, wherein said inner side of said floatation ring is extended substantially perpendicular to said upper and lower faces of said floatation ring such that said inner side has a generally cylindrical shape.

3. The floatation device of claim 1, wherein an adhesive between said floatation ring and said cover sheet couples said cover sheet to said floatation ring.

4. The floatation device of claim 1, wherein a safety harness is provided in said seat region to secure a user in said seat region, said safety harness comprising a pair of waist straps detachably attached together and a leg strap coupled to one of said waist straps, said waist straps being coupled to said cover sheet adjacent said inner side of said floatation ring, said leg strap being coupled to said lower portion of said center region of said cover sheet between said leg holes.

5. A floatation device, comprising:

a floatation ring having substantially planar upper and lower faces, and inner and outer sides, said inner side of said floatation ring defining a generally cylindrical center opening through said ring extending between said upper and lower faces of said floatation ring;

said upper and lower faces lying in substantially parallel with one another;

said upper and lower faces of said flotation ring each having a generally circular outer perimeter, said upper and lower faces of said floatation ring having substantially coaxial centers;

said upper face of said floatation ring having an outer diameter defined across said outer perimeter of said upper face less than an outer diameter of said lower face of said floatation ring defined across said outer perimeter of said lower face of said floatation ring;

said inner side of said floatation ring being extended substantially perpendicular to said upper and lower faces of said floatation ring such that said inner side has a generally cylindrical shape;

said outer side of said floatation ring extending at an acute angle to said lower face of said floatation ring and at an obtuse angle to said upper face of said floatation ring such that said outer side has a generally frusta-conical shape tapering in a direction from said lower face to said upper face of said floatation ring to provide enhanced stability to said to said floatation ring when floating in a body of water;

said floatation ring comprising a foamed material;

a flexible cover sheet having a center region and a generally circular outer perimeter;

said outer perimeter of said cover sheet being coupled to said floatation ring along said inner side of said floatation ring adjacent said lower face of said floatation ring;

said cover sheet being wrapped around said floatation ring to substantially cover said lower face, said outer side, said upper face, and said inner side of said floatation ring such that said outer perimeter of said cover sheet is positioned about said inner side of said floatation ring adjacent said lower face of said floatation ring and said center region of said cover sheet is extended from said upper face of said floatation ring through said center hole of said floatation ring such that a lower portion of said center region of said cover sheet downwardly depends from the lower face side of said center hole;

wherein an adhesive between said floatation ring and said cover sheet couples said cover sheet to said floatation ring, wherein said adhesive substantially coats said floatation ring;

wherein said cover sheet comprises a flexible vinyl material that is resistant to the passage of water therethrough;

said lower portion of said cover sheet forming a seat region adapted for receiving a lower torso region of a user therein such that the upper torso and head of the user upwardly extend above the upper face of the floatation ring from the center hole;

said cover sheet having a pair of leg holes therethrough in said lower portion of center region of said cover sheet, said leg holes being adapted for extending the legs of a user in said seat region; and a safety harness being provided in said scat region to secure a user in said seat region, said safety harness comprising a pair of waist straps detachably attached together and a leg strap coupled to one of said waist straps, said waist straps being coupled to said cover sheet adjacent said inner side of said floatation ring, said leg strap being coupled to said lower portion of said center region of said cover sheet between said leg holes.

6. A floatation device, comprising:

a floatation ring having upper and lower faces, and inner and outer sides, said inner side of said floatation ring defining a center opening through said ring extending between said upper and lower faces of said floatation ring;

a flexible cover sheet having a center region and an outer perimeter;

said outer perimeter of said cover sheet being coupled to said floatation ring along said inner side of said floatation ring;

said cover sheet being wrapped around said floatation ring to substantially cover said lower face, said outer side, said upper face, and said inner side of said floatation ring such that said outer perimeter of said cover sheet is positioned about said inner side of said floatation ring adjacent said lower face of said floatation ring and said center region of said cover sheet is extended from said upper face of said floatation ring through said center hole of said floatation ring such that a lower portion of said center region of said cover sheet downwardly depends from the lower face side of said center hole;

said lower portion of said cover sheet forming a seat region adapted for receiving a user therein, said cover sheet having a pair of leg holes therethrough in said lower portion of center region of said cover sheet; and wherein a safety harness is provided in said seat region to secure a user in said seat region, said safety harness comprising a pair of waist straps detachably attached together and a leg strap coupled to one of said waist straps, said waist straps being coupled to said cover sheet adjacent said inner side of said floatation ring, said leg strap being coupled to said lower portion of said center region of said cover sheet between said leg holes.

7. The floatation device of claim 6, wherein an adhesive between said floatation ring and said cover sheet couples said cover sheet to said floatation ring.

* * * * *